US011261885B2

(12) United States Patent
Takakuwa et al.

(10) Patent No.: US 11,261,885 B2
(45) Date of Patent: Mar. 1, 2022

(54) FLUID PRESSURE CYLINDER

(71) Applicant: SMC CORPORATION, Tokyo (JP)

(72) Inventors: Youji Takakuwa, Kitakatsushika-gun (JP); Hiroyuki Asahara, Tsukuba (JP); Seiichi Nagura, Moriya (JP)

(73) Assignee: SMC CORPORATION, Tokyo (JP)

( * ) Notice: Subject to any disclaimer, the term of this patent is extended or adjusted under 35 U.S.C. 154(b) by 0 days.

(21) Appl. No.: 17/227,499

(22) Filed: Apr. 12, 2021

(65) Prior Publication Data

US 2021/0317850 A1 Oct. 14, 2021

(30) Foreign Application Priority Data

Apr. 14, 2020 (JP) ..... JP2020-072048

(51) Int. Cl.
*F15B 15/14* (2006.01)
*F15B 15/20* (2006.01)

(52) U.S. Cl.
CPC ..... *F15B 15/1404* (2013.01); *F15B 15/1428* (2013.01); *F15B 15/202* (2013.01)

(58) Field of Classification Search
CPC .. F15B 15/1404; F15B 15/202; F15B 15/204; F15B 15/1428; F15B 2211/7107
See application file for complete search history.

(56) References Cited

U.S. PATENT DOCUMENTS 3,818,801 A * 6/1974 Kime ..... F15B 15/149 91/519
4,128,380 A * 12/1978 Jamann ..... B29C 45/6771 425/450.1

(Continued)

FOREIGN PATENT DOCUMENTS

DE 25 44 105 A1 4/1977
EP 3 835 600 A1 6/2021

(Continued)

OTHER PUBLICATIONS

Extended European Search Repon dated Aug. 12, 2021 in corresponding European Patent Application No. 21167555.8, 10 pages.

*Primary Examiner* — Thomas E Lazo
(74) *Attorney, Agent, or Firm* — Oblon, McClelland, Maier & Neustadt, L.L.P.

(57) ABSTRACT

A fluid pressure cylinder includes a first cylinder portion and a second cylinder portion disposed in parallel, and a supply-and-discharge port. The first cylinder portion is partitioned by a first piston into a head-side first accumulation chamber and a rod-side second accumulation chamber. The second cylinder portion is partitioned by a second piston into a head-side release chamber and a rod-side drive chamber. Pressurized fluid is supplied to and discharged from the second accumulation chamber and the drive chamber through the supply-and-discharge port. An end of a first piston rod connected to the first piston and an end of a second piston rod connected to the second piston are connected to each other. The first piston includes a communication switching valve switching communication between the first accumulation chamber and the second accumulation chamber, between enabled and disabled.

10 Claims, 12 Drawing Sheets

(56) References Cited

U.S. PATENT DOCUMENTS

| | | | | | |
|---|---|---|---|---|---|
| 4,861,259 | A * | 8/1989 | Takada | B29C 45/6771 | 425/451.2 |
| 5,263,402 | A * | 11/1993 | Gottlieb | B23Q 1/267 | 91/167 R |
| 8,100,046 | B2 * | 1/2012 | Tunkers | F15B 11/022 | 91/395 |
| 9,550,228 | B2 * | 1/2017 | Wilcox | B21J 15/18 | |
| 9,587,658 | B2 * | 3/2017 | Okamoto | B64C 13/505 | |
| 10,316,868 | B2 * | 6/2019 | Asaba | F15B 15/1404 | |
| 2012/0272708 | A1 * | 11/2012 | Scheidl | B30B 15/16 | 72/453.07 |

FOREIGN PATENT DOCUMENTS

| | | | |
|---|---|---|---|
| JP | 5048696 | B2 | 10/2012 |
| WO | WO 2020/054322 | A1 | 3/2020 |

* cited by examiner

FLUID PRESSURE CYLINDER

CROSS-REFERENCE TO RELATED APPLICATION

This application is based upon and claims the benefit of priority from Japanese Patent Application No. 2020-072048 filed on Apr. 14, 2020, the contents of which are incorporated herein by reference.

BACKGROUND OF THE INVENTION

Field of the Invention

The present invention relates to a fluid pressure cylinder including a cylinder portion for transfer and a cylinder portion for output.

Description of the Related Art

A fluid pressure cylinder, which is used for, for example, a clamping mechanism and which includes separate cylinders for moving an end of a piston rod to a position adjacent to a workpiece (transfer cylinder) and for performing predetermined tasks on the workpiece using the end of the piston rod (output cylinder), is well known in the art.

For example, an air cylinder described in Japanese Patent No. 5048696 includes a booster cylinder disposed between a pair of drive cylinders. In the air cylinder, while air is supplied to second cylinder chambers of the drive cylinders to cause a booster rod and drive rods to advance, there is little or no difference in pressure between a third cylinder chamber and a fourth cylinder chamber of the booster cylinder, and thus no or little advance thrust acts on the booster rod. When a connector plate connecting the booster rod and the drive rods comes into contact with a workpiece and causes the booster rod and the drive rods to stop, the pressure in first cylinder chambers of the drive cylinders drops, and a valve element of a first valve device is switched to a boost position. This causes the pressure in the third cylinder chamber to be atmospheric while the fourth cylinder chamber is being pressurized, and thereby advance thrust acts on the booster rod.

SUMMARY OF THE INVENTION

In the above-described air cylinder, air needs to be supplied to the first cylinder chambers of the drive cylinders to return the drive rods, placing a limit on the reduction in the air consumption. Moreover, two pipes need to be disposed between the drive cylinders and a switching valve that switches between supplying air to the first cylinder chambers while discharging air from the second cylinder chambers and supplying air to the second cylinder chambers while discharging air from the first cylinder chambers. A fluid pressure cylinder including a piston rod for a transfer cylinder and a piston rod for an output cylinder coaxially connected in series is also well known, and has problems similar to those described above in addition to an undesirable increase in size due to the extended total length.

The present invention has been devised taking into consideration the aforementioned problems, and has the object of providing a compact fluid pressure cylinder including a cylinder portion for transfer and a cylinder portion for output and consuming as little pressurized fluid as possible. The present invention also has the object of providing a fluid pressure cylinder requiring only one connection pipe.

A fluid pressure cylinder according to the present invention includes: a first cylinder portion and a second cylinder portion disposed in parallel; and a supply-and-discharge port. The first cylinder portion is partitioned by a first piston into a first accumulation chamber disposed on a head side and a second accumulation chamber disposed on a rod side. The second cylinder portion is partitioned by a second piston into a release chamber disposed on the head side and a drive chamber disposed on the rod side. Pressurized fluid is supplied to and discharged from the second accumulation chamber and the drive chamber through the supply-and-discharge port. An end of a first piston rod connected to the first piston and an end of a second piston rod connected to the second piston are connected to each other. The first piston is provided with a communication switching valve configured to switch communication between the first accumulation chamber and the second accumulation chamber, between enabled and disabled.

According to the fluid pressure cylinder, pressurized fluid may be supplied to the second cylinder portion configured as a transfer cylinder only when the second piston is moved in one direction (return direction). This reduces the consumption of pressurized fluid to the fullest extent possible. Moreover, the parallel arrangement of the first cylinder portion and the second cylinder portion prevents the fluid pressure cylinder from increasing in size. Furthermore, a pipe connecting to the supply-and-discharge port is the only pipe required to connect to the fluid pressure cylinder. This facilitates pipe routing.

In addition, a fluid pressure cylinder according to the present invention includes a first cylinder portion and a second cylinder portion disposed in parallel. The first cylinder portion is partitioned by a first piston into a first accumulation chamber disposed on a head side and a second accumulation chamber disposed on a rod side. The second cylinder portion is partitioned by a second piston into a release chamber disposed on the head side and a drive chamber disposed on the rod side. An end of a first piston rod connected to the first piston and an end of a second piston rod connected to the second piston are connected to each other. The first piston is provided with a communication switching valve configured to switch communication between the first accumulation chamber and the second accumulation chamber, between enabled and disabled. During a retraction stroke, pressurized fluid is supplied from a fluid supply source to the drive chamber and the second accumulation chamber while the first accumulation chamber and the second accumulation chamber communicate with each other, whereas, during an extension stroke, pressurized fluid in the drive chamber is discharged while the first accumulation chamber and the second accumulation chamber communicate with each other.

According to the fluid pressure cylinder, pressurized fluid may be supplied to the second cylinder portion configured as a transfer cylinder only when the second piston is moved in one direction (return direction), that is, during the retraction stroke. This reduces the consumption of pressurized fluid to the fullest extent possible. Moreover, the parallel arrangement of the first cylinder portion and the second cylinder portion prevents the fluid pressure cylinder from increasing in size.

In the fluid pressure cylinder according to the present invention, the first piston in the first cylinder portion configured as an output cylinder can be advanced using the difference between the pressure-receiving areas in the first piston caused by connecting the first accumulation chamber and the second accumulation chamber to each other. That is, the first cylinder portion can function as an advance transfer cylinder, and thus pressurized fluid may be supplied to the second cylinder portion only when the second piston is returned. This ultimately reduces the consumption of pressurized fluid. Moreover, since pressurized fluid is supplied to and discharged from the second accumulation chamber and the drive chamber through the single supply-and-discharge port, only one pipe is required to connect to the fluid pressure cylinder, facilitating pipe routing.

The above and other objects, features, and advantages of the present invention will become more apparent from the following description when taken in conjunction with the accompanying drawings, in which a preferred embodiment of the present invention is shown by way of illustrative example.

DESCRIPTION OF THE PREFERRED EMBODIMENT

A preferred embodiment of a fluid pressure cylinder according to the present invention will be described in detail below with reference to the accompanying drawings. A fluid pressure cylinder 10 is connected to a supply-and-discharge switching valve 90 to perform tasks such as positioning of workpieces. Fluid to be used includes pressurized fluid such as compressed air.

Figure 1:
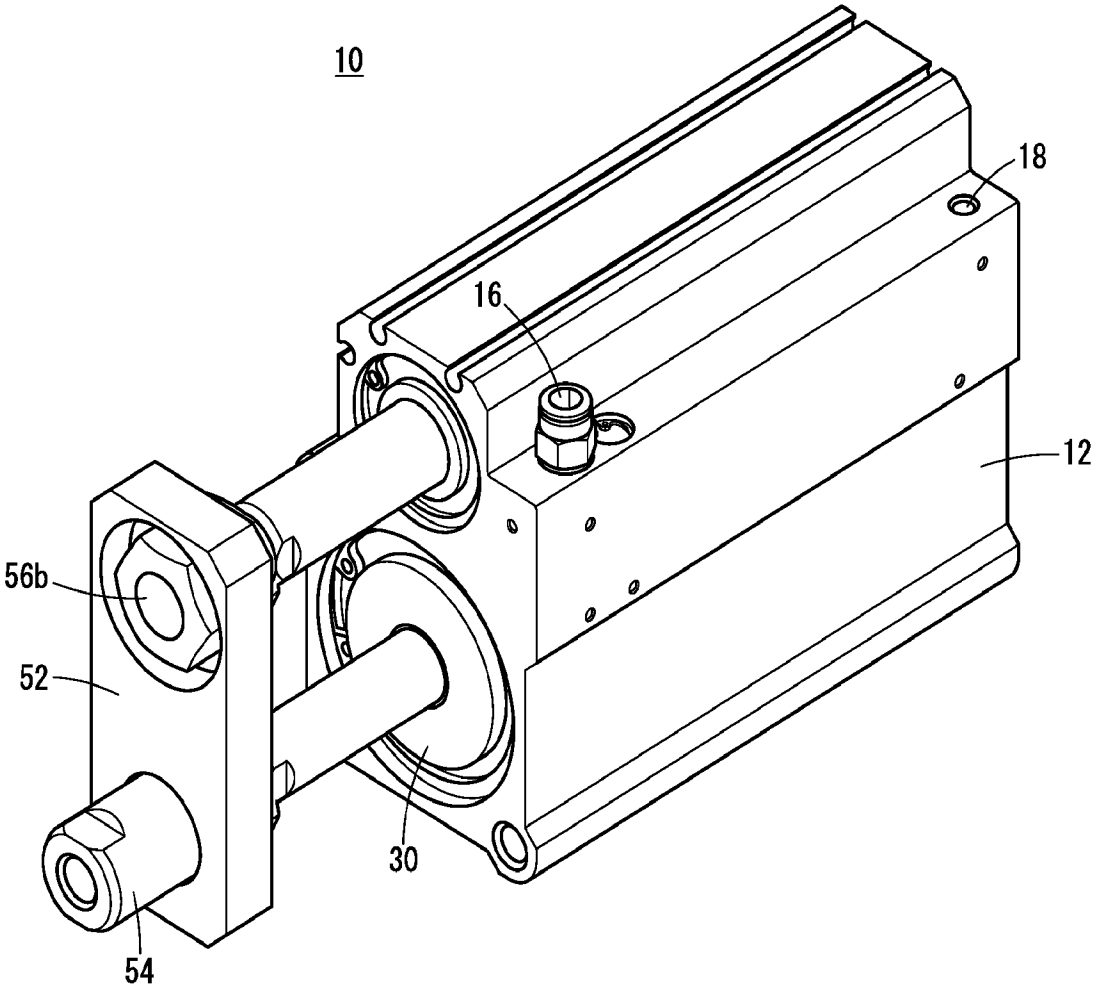
FIG. 1 is a schematic perspective view of a fluid pressure cylinder according to an embodiment of the present invention.
Figure 2:
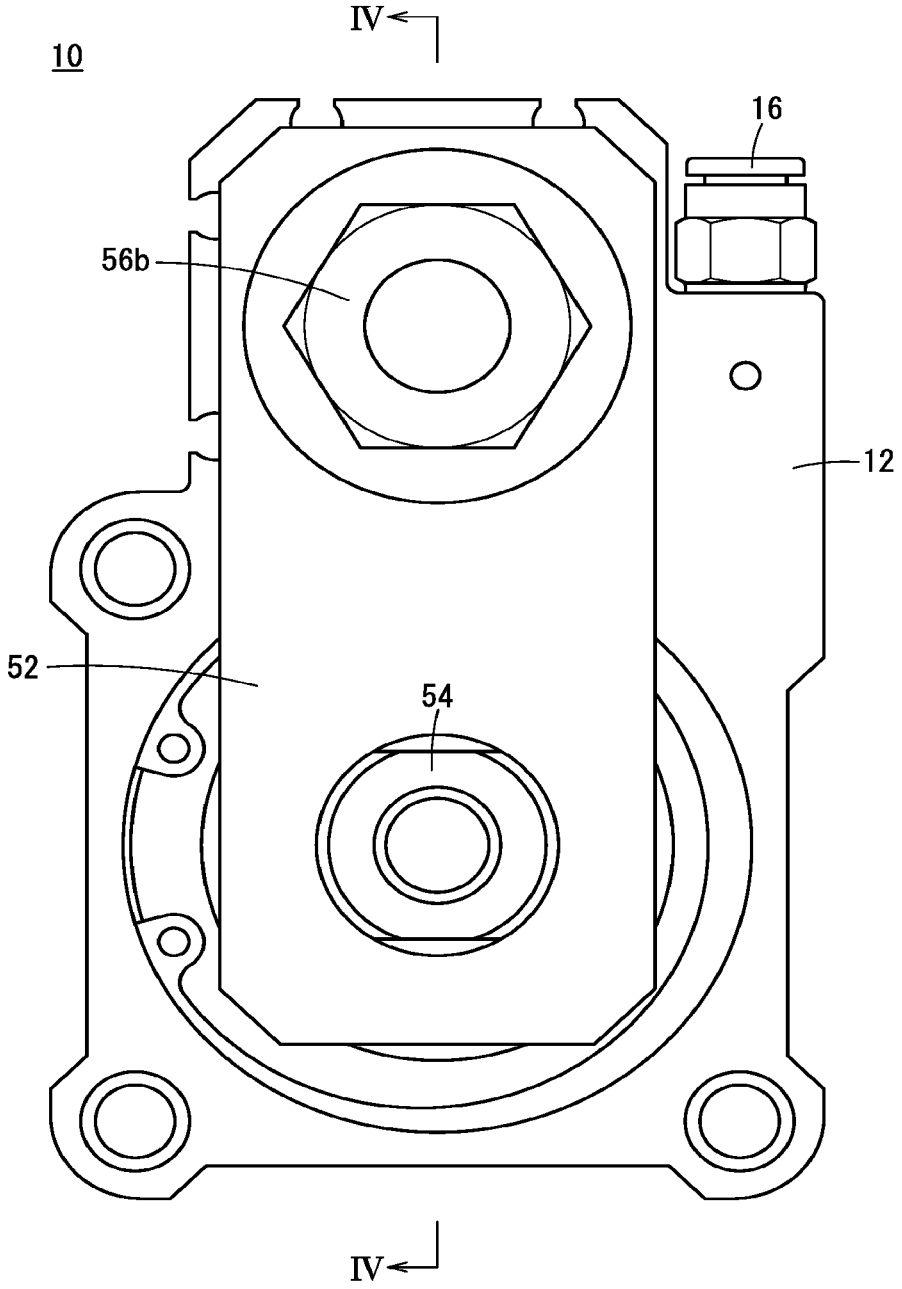
FIG. 2 is a front view of the fluid pressure cylinder in FIG. 1.
Figure 4:
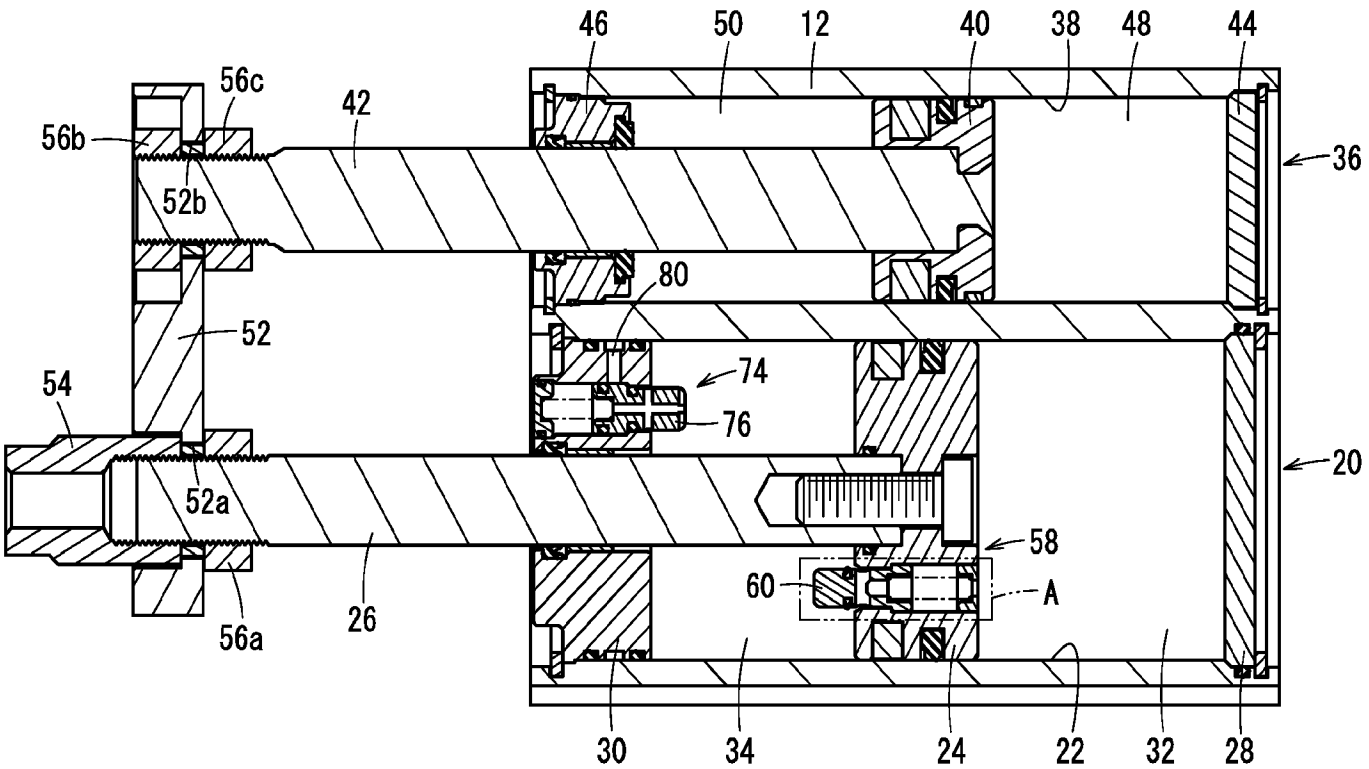
FIG. 4 is a cross-sectional view of the fluid pressure cylinder in FIG. 1 taken along line IV-IV in FIG. 2.
Figure 6:
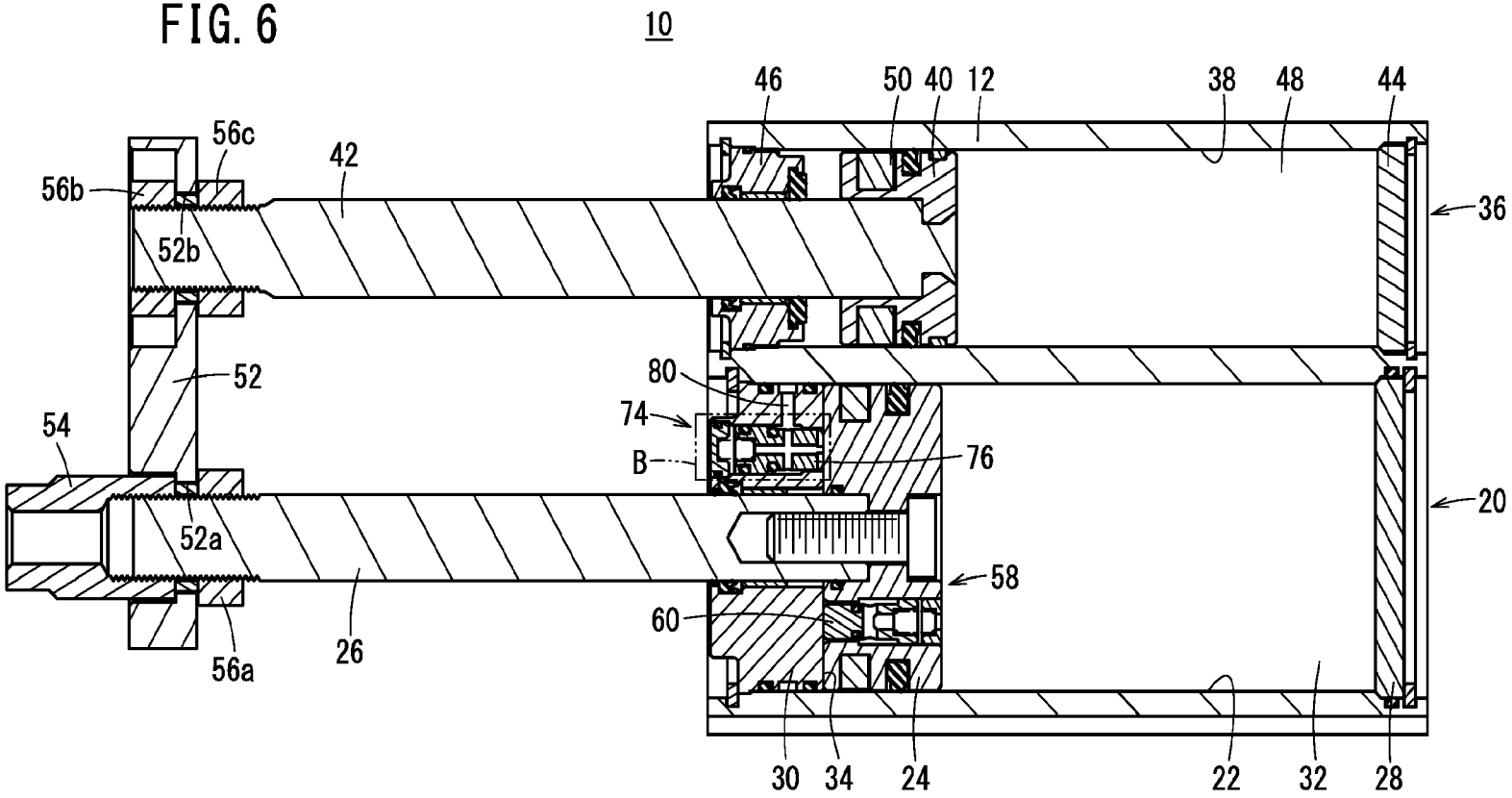
FIG. 6 is a diagram corresponding to FIG. 4 at the end of an extension stroke.

As illustrated in FIGS. 1, 4, and 6, the fluid pressure cylinder 10 includes a rectangular parallelepiped cylinder body 12 with a first cylinder hole 22 and a second cylinder hole 38 having a smaller diameter than the first cylinder hole 22. The first cylinder hole 22 and the second cylinder hole 38 extend from one longitudinal end to the other longitudinal end of the cylinder body 12 and are aligned vertically.

One end of the first cylinder hole 22 is closed by a first head cover 28, whereas the other end of the first cylinder hole 22 is closed by a first rod cover 30. The first cylinder hole 22 and a first piston 24 slidably disposed inside the first cylinder hole 22 constitute a first cylinder portion 20. The first cylinder hole 22 is partitioned by the first piston 24 into a first accumulation chamber 32 adjacent to the first head cover 28 (head side) and a second accumulation chamber 34 adjacent to the first rod cover 30 (rod side). As is clear from the explanation of effects below, the first cylinder portion 20 functions as an advance transfer cylinder as well as an output cylinder.

One end of the second cylinder hole 38 is closed by a second head cover 44, whereas the other end of the second cylinder hole 38 is closed by a second rod cover 46. The second cylinder hole 38 and a second piston 40 slidably disposed inside the second cylinder hole 38 constitute a second cylinder portion 36. The second cylinder hole 38 is partitioned by the second piston 40 into a release chamber 48 adjacent to the second head cover 44 (head side) and a drive chamber 50 adjacent to the second rod cover 46 (rod side). The second cylinder portion 36 functions as a return transfer cylinder. The first cylinder portion 20 and the second cylinder portion 36 are disposed in parallel.

One end part of a first piston rod 26 is connected to the first piston 24, whereas the other end part of the first piston rod 26 extends to the outside through the first rod cover 30. One end part of a second piston rod 42 is connected to the second piston 40, whereas the other end part of the second piston rod 42 extends to the outside through the second rod cover 46.

The other end part of the first piston rod 26 and the other end part of the second piston rod 42 are connected by a rectangular connector plate 52. Specifically, with the other end part of the first piston rod 26 fitted in a first insertion hole 52*a* created in the connector plate 52, an output member 54 and a first nut 56*a* disposed on either side of the first insertion hole 52*a* are screwed onto the first piston rod 26, thereby securing the first piston rod 26 to the connector plate 52. Moreover, with the other end part of the second piston rod 42 fitted in a second insertion hole 52*b* created in the connector plate 52, a second nut 56*b* and a third nut 56*c* disposed on either side of the second insertion hole 52*b* are screwed onto the second piston rod 42, thereby securing the second piston rod 42 to the connector plate 52.

In this case, the inside diameter of the first insertion hole 52*a* is larger than the outside diameter of the first piston rod 26, and the inside diameter of the second insertion hole 52*b* is larger than the outside diameter of the second piston rod 42. As a result, even if there are production errors and assembly errors, the first piston rod 26 and the second piston rod 42 can be kept parallel to each other, and sliding resistance of the first piston 24 and the second piston 40 can thus be reduced. The first piston 24 and the second piston 40 move in an integrated manner via the first piston rod 26, the connector plate 52, and the second piston rod 42.

In the description below, a stroke in which the first piston 24 and the second piston 40 move in a direction in which the first piston rod 26 and the second piston rod 42 are pushed out of the cylinder body 12 (advance direction) is referred to as "extension stroke", whereas a stroke in which the first piston 24 and the second piston 40 move in a direction in which the first piston rod 26 and the second piston rod 42 are pulled into the cylinder body 12 (return direction) is referred to as "retraction stroke". The fluid pressure cylinder 10 performs tasks when the output member 54 is pushed out integrally with the first piston rod 26.

Figure 3:
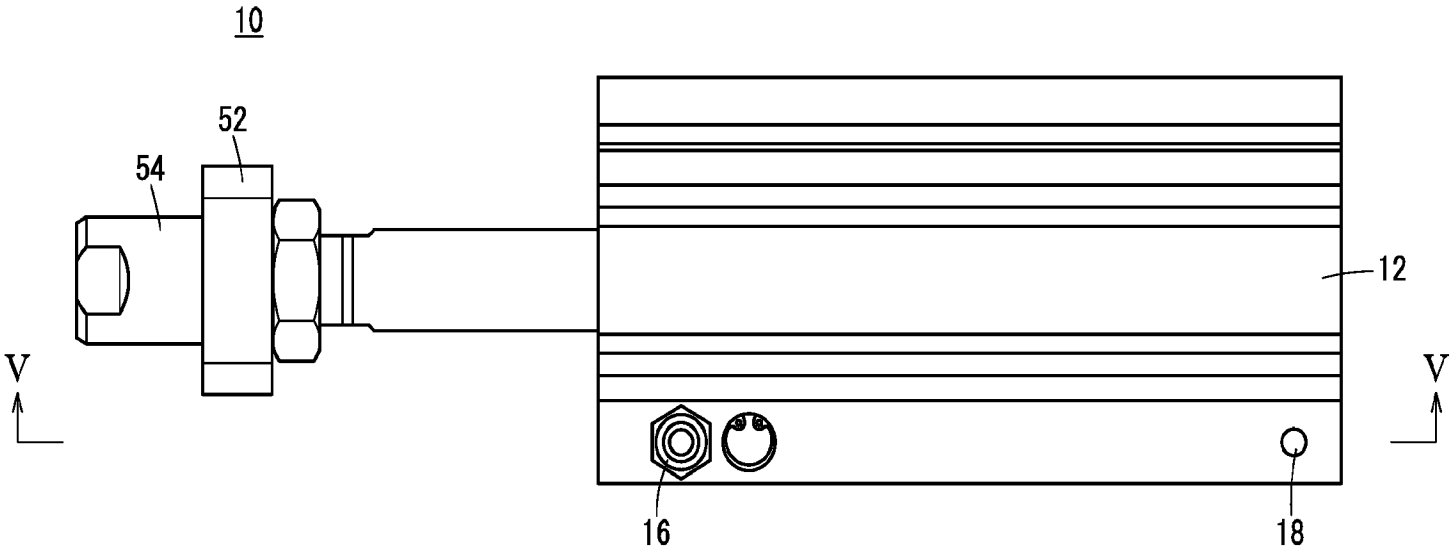
FIG. 3 is a plan view of the fluid pressure cylinder in FIG. 1.

As illustrated in FIGS. 1 and 3, a supply-and-discharge port 16 and a release port 18 are created in the top surface of the cylinder body 12. The supply-and-discharge port 16 is connected to the supply-and-discharge switching valve 90 via a pipe 94 (see FIG. 9). The release port 18 is exposed to the atmosphere.

Figure 5:
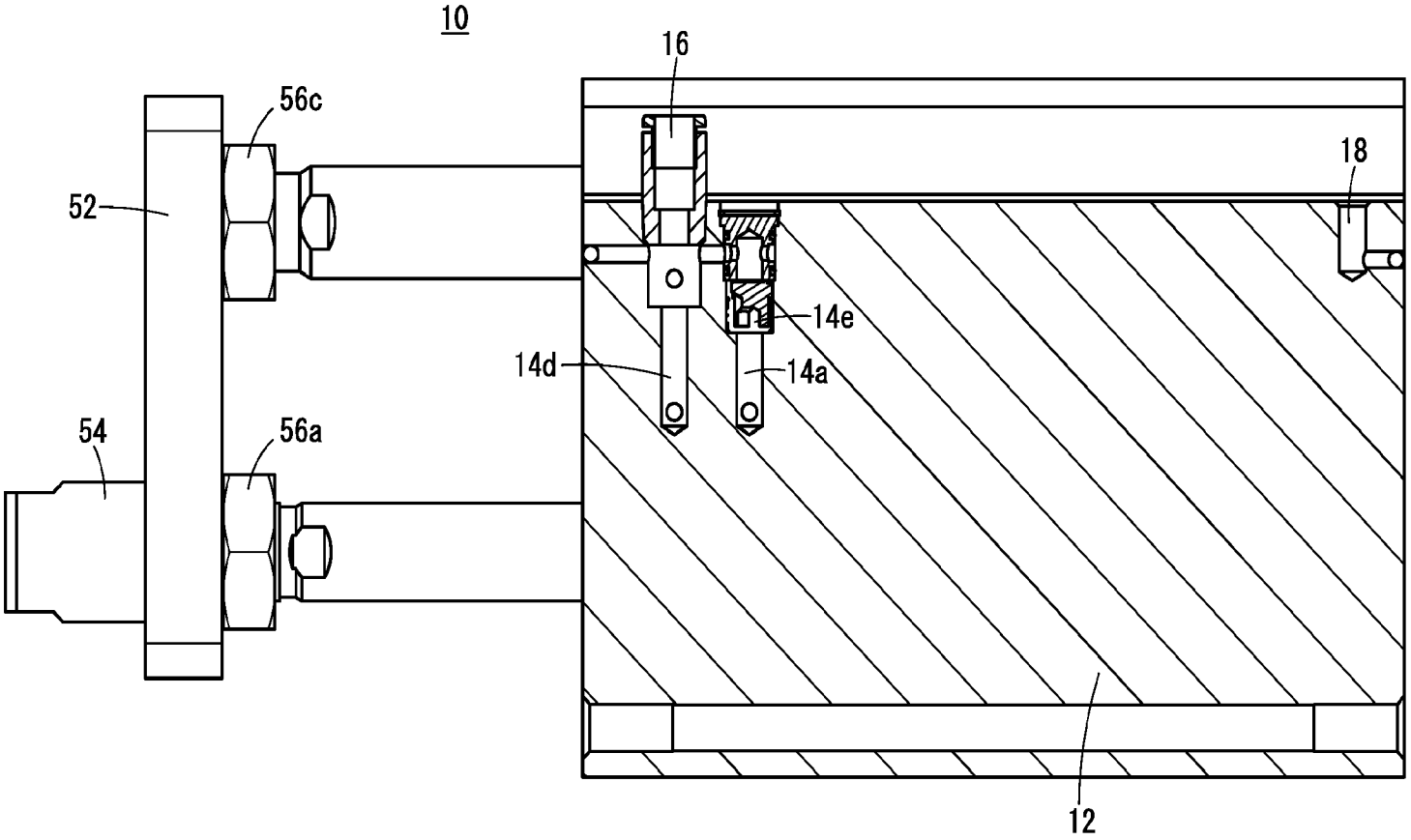
FIG. 5 is a cross-sectional view of the fluid pressure cylinder in FIG. 1 taken along line V-V in FIG. 3.
Figure 9:
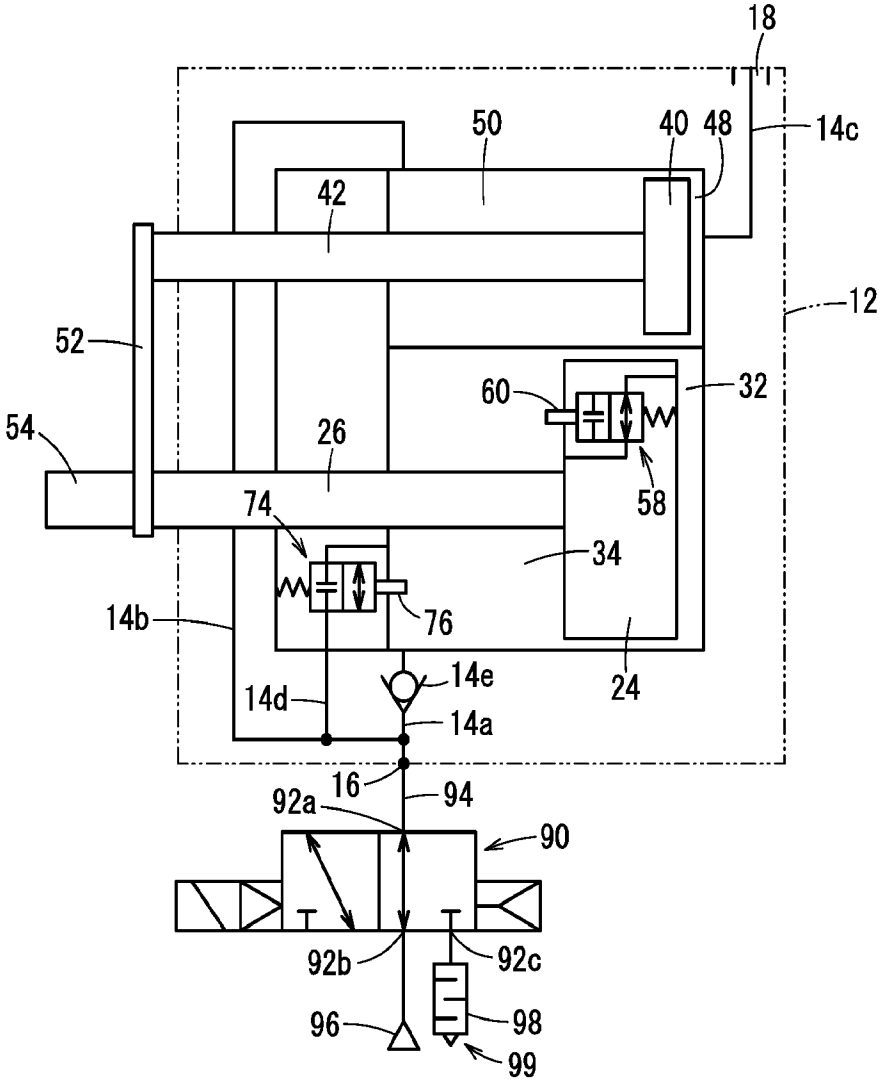
FIG. 9 is a circuit diagram schematically illustrating the fluid pressure cylinder in FIG. 1 and a supply-and-discharge switching valve at the end of a retraction stroke.
Figure 10:
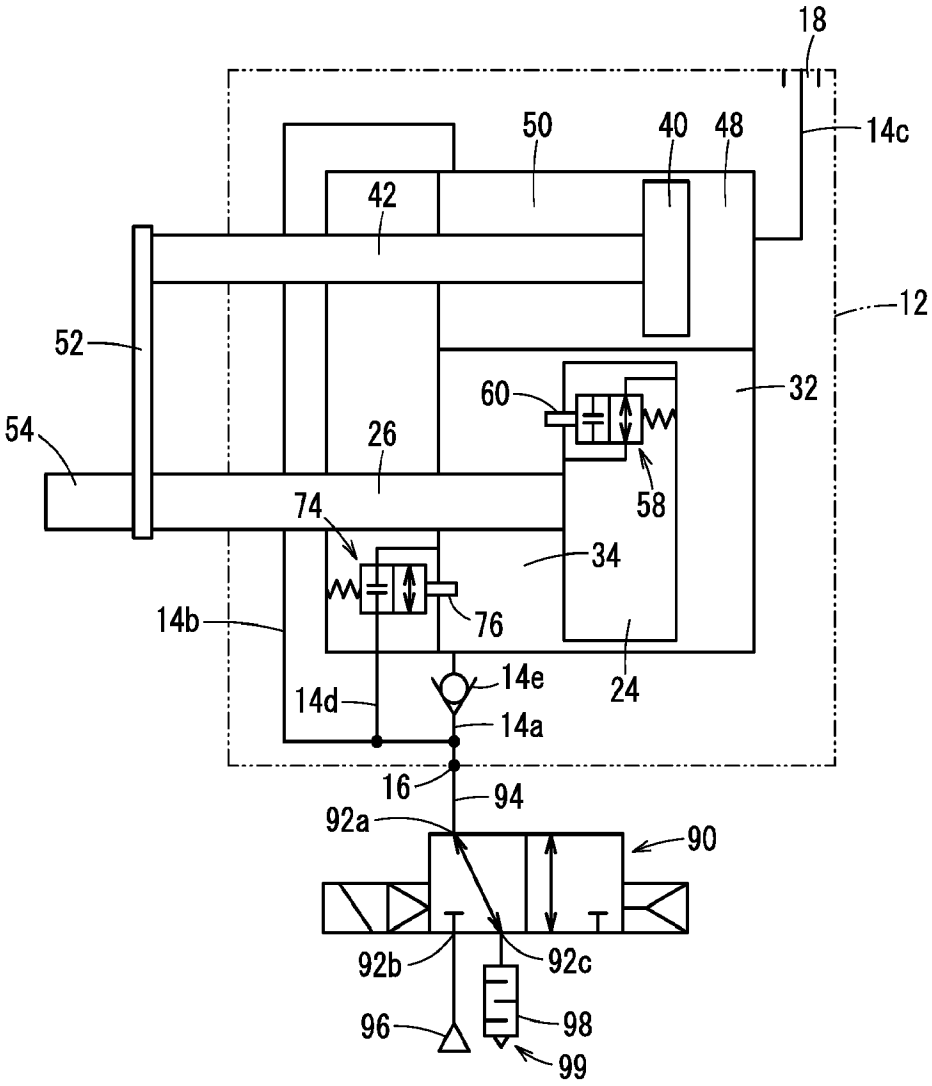
FIG. 10 is a circuit diagram schematically illustrating the fluid pressure cylinder in FIG. 1 and the supply-and-discharge switching valve during the extension stroke.
Figure 11:
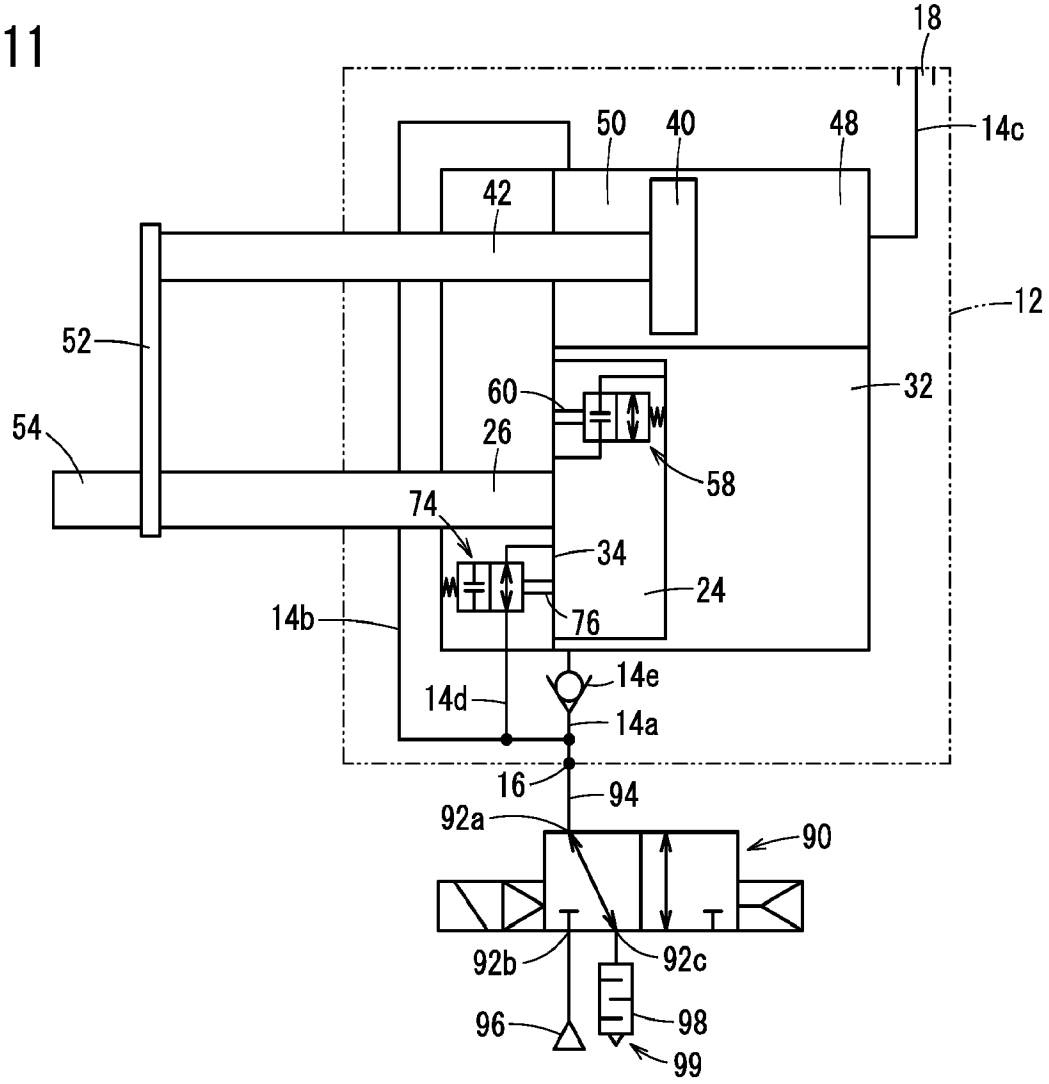
FIG. 11 is a circuit diagram schematically illustrating the fluid pressure cylinder in FIG. 1 and the supply-and-discharge switching valve at the end of the extension stroke.
Figure 12:
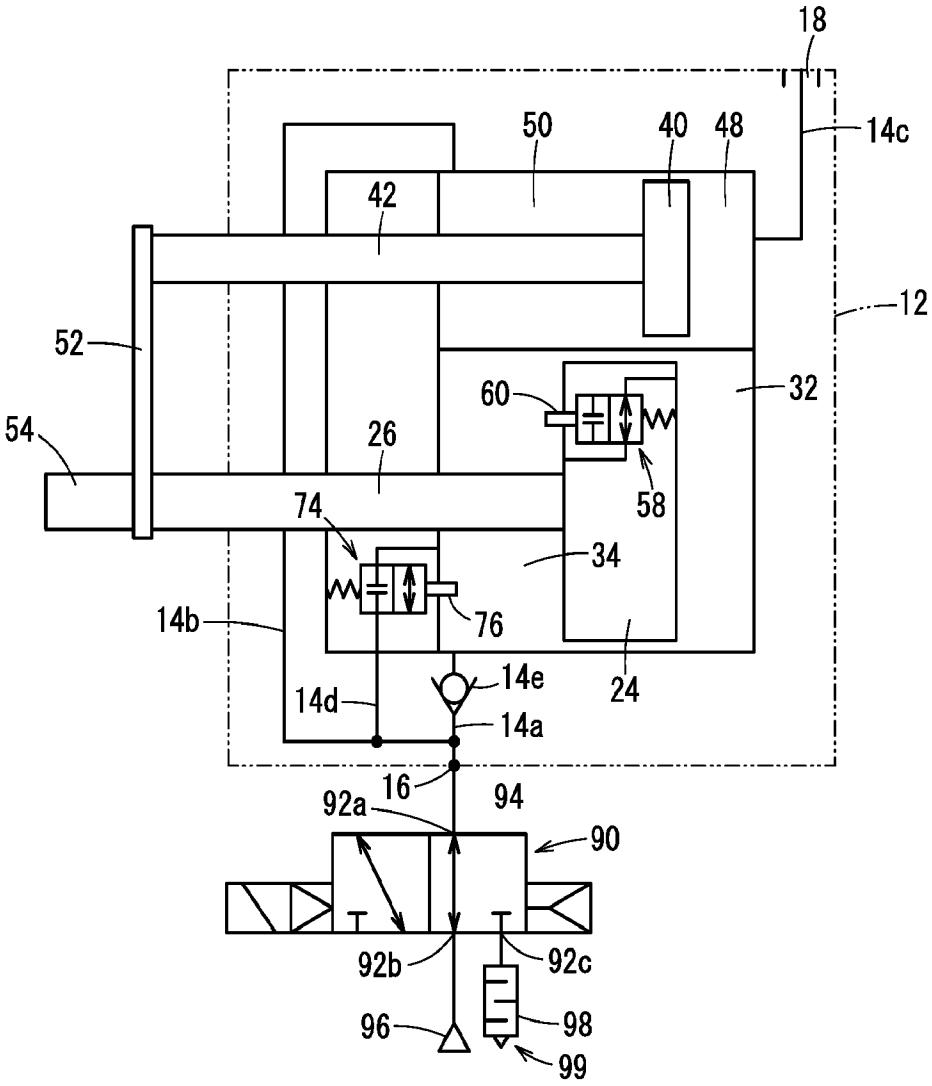
FIG. 12 is a circuit diagram schematically illustrating the fluid pressure cylinder in FIG. 1 and the supply-and-discharge switching valve during the retraction stroke.

The cylinder body 12 includes a first flow path 14*a* connecting the second accumulation chamber 34 to the supply-and-discharge port 16, a second flow path 14*b* connecting the drive chamber 50 to the supply-and-discharge port 16, and a third flow path 14*c* connecting the release chamber 48 to the release port 18 (see FIG. 9). A check valve 14*e* is disposed on the first flow path 14*a*. The check valve 14*e* allows fluid to flow from the supply-and-discharge switching valve 90 toward the second accumulation chamber 34 and blocks flow of fluid from the second accumulation chamber 34 toward the supply-and-discharge switching valve 90. The cylinder body 12 further includes a fourth flow path 14*d* connecting a radial path 80 in a discharge switching valve 74 (described below) to the supply-and-discharge port 16. Part of the first flow path 14*a* and part of the fourth flow path 14*d* are illustrated in FIG. 5.

The first piston 24 is provided with a communication switching valve 58 for switching communication between the first accumulation chamber 32 and the second accumulation chamber 34, between enabled and disabled. The communication switching valve 58 includes a first push rod 60 protruding toward the inside of the second accumulation chamber 34.

Figure 7:
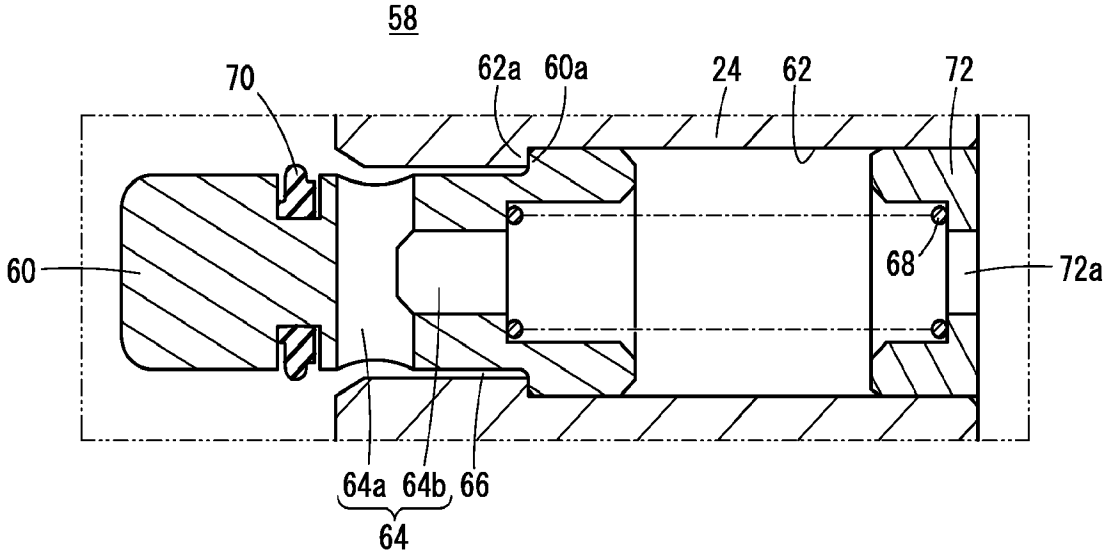
FIG. 7 is an enlarged view of part A in FIG. 4.

As illustrated in FIG. 7, the first push rod 60 is slidably supported inside a guide hole 62 passing through the first piston 24 in the axial direction. The first push rod 60 includes a communication path 64 for connecting the first accumulation chamber 32 and the second accumulation chamber 34 to each other. The communication path 64 includes a first hole portion 64*a* passing through the first push rod 60 in a radial direction, and a second hole portion 64*b* branching off from a point in the first hole portion 64*a* to extend toward the first accumulation chamber 32. Both ends of the first hole portion 64*a* are open to an annular gap 66 left between the outer circumference of the first push rod 60 and the wall surface of the guide hole 62, whereas the end of the second hole portion 64*b* communicates with the first accumulation chamber 32. When the first push rod 60 protrudes toward the inside of the second accumulation chamber 34 by a predetermined length or more, the annular gap 66 communicates with the second accumulation chamber 34.

The first push rod 60 is biased in a direction of protruding toward the inside of the second accumulation chamber 34, by a coil spring 68 disposed between the first push rod 60 and a spring seat 72 secured to the first piston 24. The first push rod 60 includes a shoulder 60*a* that engages with a shoulder 62*a* provided for the guide hole 62. This engagement limits the protruding length of the first push rod 60 and prevents the first push rod 60 from coming off. Note that the spring seat 72 has a hole 72*a* in the center.

Near the end of the extension stroke, the first push rod 60 comes into contact with the first rod cover 30, is pushed in against the biasing force of the coil spring 68, and slides inside the guide hole 62. When the first push rod 60 is pushed in, a packing 70 attached to the outer circumference of the first push rod 60 comes into contact with the wall surface of the guide hole 62 and blocks the communication between the annular gap 66 and the second accumulation chamber 34. That is, the communication switching valve 58 blocks the communication between the first accumulation chamber 32 and the second accumulation chamber 34 near the end of the extension stroke. The first push rod 60 can be pushed in to a position where the first push rod 60 does not protrude from the end face of the first piston 24.

The first rod cover 30 is provided with the discharge switching valve 74 that switches connection of the second accumulation chamber 34 to the supply-and-discharge switching valve 90 between enabled and disabled to allow pressurized fluid inside the second accumulation chamber 34 to be discharged. The discharge switching valve 74 includes a second push rod 76 protruding toward the inside of the second accumulation chamber 34. When viewed in the direction along the axis of the first piston rod 26, the first push rod 60 of the communication switching valve 58 and the second push rod 76 of the discharge switching valve 74 are separated from the axis in the opposite directions (180 degrees opposite to each other) by an equal distance.

Figure 8:
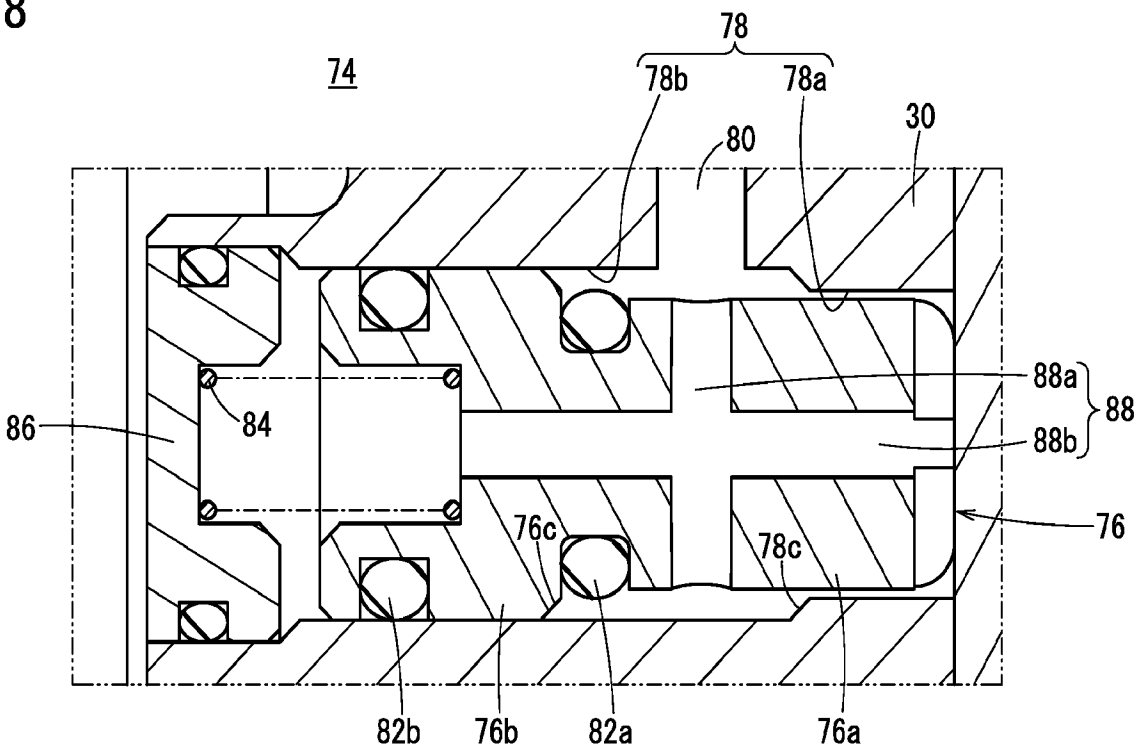
FIG. 8 is an enlarged view of part B in FIG. 6.

As illustrated in FIG. 8, the second push rod 76 is slidably supported inside a guide hole 78 passing through the first rod cover 30 in the axial direction. The guide hole 78 in the first rod cover 30 includes a small-diameter hole portion 78*a* adjacent to the second accumulation chamber 34, and a large-diameter hole portion 78*b* away from the second accumulation chamber 34. The second push rod 76 includes a small-diameter shaft portion 76*a* fitted in the small-diameter hole portion 78*a*, and a large-diameter shaft portion 76*b* fitted in the large-diameter hole portion 78*b*. O-rings 82*a* and 82*b* are attached to the outer circumferences of the small-diameter shaft portion 76*a* and the large-diameter shaft portion 76*b*, respectively.

The second push rod 76 is biased in a direction in which the small-diameter shaft portion 76*a* protrudes toward the inside of the second accumulation chamber 34, by a coil spring 84 disposed between the second push rod 76 and a spring seat 86 secured to the first rod cover 30. The protruding length of the second push rod 76 is limited by engagement of a shoulder 76*c* formed between the small-diameter shaft portion 76*a* and the large-diameter shaft portion 76*b* with a shoulder 78*c* formed between the small-diameter hole portion 78*a* and the large-diameter hole portion 78*b*.

The first rod cover 30 includes the radial path 80 having one end opened in the outer circumferential surface of the first rod cover 30, and the other end opened in the large-diameter hole portion 78*b*. As described above, the radial path 80 communicates with the fourth flow path 14*d* in the cylinder body 12. The second push rod 76 includes a discharge path 88 for connecting the second accumulation chamber 34 and the radial path 80 to each other. The discharge path 88 includes a first hole portion 88*a* passing through the small-diameter shaft portion 76*a* of the second push rod 76 in a radial direction, and a second hole portion 88*b* crossing the first hole portion 88*a* and passing through the second push rod 76 in the axial direction.

Near the end of the extension stroke, the second push rod 76 comes into contact with the first piston 24, is pushed in against the biasing force of the coil spring 84, and slides inside the guide hole 78. When the second push rod 76 is pushed in, the O-ring 82*a* attached to the small-diameter shaft portion 76*a* is separated from the wall surface of the small-diameter hole portion 78*a*, and the second accumulation chamber 34 communicates with the radial path 80 in the first rod cover 30 via the discharge path 88 in the second push rod 76. As a result, the second accumulation chamber 34 is connected to the supply-and-discharge switching valve 90 via the discharge path 88, the radial path 80, the fourth flow path 14*d*, and the supply-and-discharge port 16. That is, the discharge switching valve 74 connects the second accumulation chamber 34 to the supply-and-discharge switching valve 90 near the end of the extension stroke. The second push rod 76 can be pushed in to a position where the second push rod 76 does not protrude from the end face of the first rod cover 30.

As illustrated in FIG. 9, the supply-and-discharge switching valve 90 is configured as a 3-port, 2-position switching valve provided with a first port 92*a* to a third port 92*c* and switchable between a first position and a second position. The first port 92*a* is connected to the supply-and-discharge port 16 in the cylinder body 12 via the pipe 94. The second port 92*b* is connected to a fluid supply source (compressor) 96. The third port 92*c* is connected to a discharge port 99 provided with a silencer 98. The first port 92*a* is connected to the second port 92*b* when the supply-and-discharge switching valve 90 is in the first position, and the first port 92*a* is connected to the third port 92*c* when the supply-and-discharge switching valve 90 is in the second position. The pipe 94 is the only pipe required to connect the fluid pressure cylinder 10 and the supply-and-discharge switching valve 90.

The fluid pressure cylinder 10 according to this embodiment is basically configured as above. Next, the effects thereof will be described. In FIGS. 9 to 12, long dashed double-short dashed lines indicate the outline of the cylinder body 12.

A state where the first piston 24 is disposed in the middle between the first head cover 28 and the first rod cover 30 as illustrated in FIG. 4 while the pressures in the first accumulation chamber 32, the second accumulation chamber 34, the drive chamber 50, and the release chamber 48 are equal to atmospheric pressure is defined as an initial state.

In this initial state, the supply-and-discharge switching valve 90 is in the second position, and thus the supply-and-discharge port 16 is connected to the discharge port 99. In addition, the first push rod 60 of the communication switching valve 58 and the second push rod 76 of the discharge switching valve 74 protrude toward the inside of the second accumulation chamber 34. Thus, the first accumulation chamber 32 and the second accumulation chamber 34 communicate with each other, and the connection between the second accumulation chamber 34 and the supply-and-discharge switching valve 90 through the fourth flow path 14*d* is blocked.

When the supply-and-discharge switching valve 90 is switched to the first position from the initial state, the supply-and-discharge port 16 is connected to the fluid supply source 96. Pressurized fluid from the fluid supply source 96 is supplied to the drive chamber 50 through the supply-and-discharge port 16 and the second flow path 14*b* and to the second accumulation chamber 34 through the supply-and-discharge port 16 and the first flow path 14*a* on which the check valve 14*e* is disposed. When pressurized fluid is supplied to the drive chamber 50, the second piston 40 is driven toward the second head cover 44. The first piston 24 is also driven toward the first head cover 28 in an integrated manner with the second piston 40.

In contrast, pressurized fluid supplied to the second accumulation chamber 34 is accumulated in the second accumulation chamber 34 and, additionally, in the first accumulation chamber 32 communicating with the second accumulation chamber 34. The first piston rod 26 and the second piston rod 42 are pulled in to the fullest extent possible, and high-pressure fluid is accumulated in the first accumulation chamber 32 and the second accumulation chamber 34 while the pressures in the accumulation chambers are kept equal (see FIG. 9). At this moment, the second piston 40 is in contact with the second head cover 44, whereas the first piston 24 is not in contact with the first head cover 28.

Next, when the supply-and-discharge switching valve 90 is switched to the second position, the supply-and-discharge port 16 is connected to the discharge port 99. Pressurized fluid in the drive chamber 50 passes through the second flow path 14*b*, the supply-and-discharge port 16, and the supply-and-discharge switching valve 90 and is then discharged from the discharge port 99 to the outside. The pressure in the drive chamber 50 decreases to atmospheric pressure equal to the pressure in the release chamber 48, and the driving force acting on the second piston 40 becomes zero.

In contrast, pressurized fluid in the second accumulation chamber 34 is not discharged due to the effect of the check valve 14*e*. The pressure of fluid accumulated in the first accumulation chamber 32 and the pressure of fluid accumulated in the second accumulation chamber 34 (the pressures being equal to each other) act on the first piston 24 with a difference of an area corresponding to the cross-section of the first piston rod 26. Thus, the force generated by the fluid pressure in the first accumulation chamber 32 and pushing the first piston 24 toward the first rod cover 30 exceeds the force generated by the fluid pressure in the second accumulation chamber 34 and pushing the first piston 24 toward the first head cover 28. As a result, the first piston 24 is driven toward the first rod cover 30; that is, the extension stroke starts (see FIG. 10).

In this manner, no pressurized fluid is supplied from the fluid supply source 96 to the fluid pressure cylinder 10 to start the extension stroke. Subsequently, near the end of the extension stroke, the first push rod 60 of the communication switching valve 58 comes into contact with the first rod cover 30, while the second push rod 76 of the discharge switching valve 74 comes into contact with the first piston 24. This blocks the communication between the first accumulation chamber 32 and the second accumulation chamber 34 and connects the second accumulation chamber 34 to the supply-and-discharge switching valve 90 via the fourth flow path 14*d* (see FIG. 11).

Pressurized fluid accumulated in the second accumulation chamber 34 passes through the fourth flow path 14*d*, the supply-and-discharge port 16, and the supply-and-discharge switching valve 90 in the second position and is then discharged from the discharge port 99 to the outside. Pressurized fluid accumulated in the first accumulation chamber 32 is prevented from flowing into the second accumulation chamber 34 and remains in the first accumulation chamber 32. As a result, the fluid pressure in the first accumulation chamber 32 significantly exceeds the fluid pressure in the second accumulation chamber 34, and the first piston 24 is pushed toward the first rod cover 30 with a large thrust. That is, the fluid pressure cylinder 10 produces the maximum force at the end of the extension stroke.

The volume of the second accumulation chamber 34 is small near the end of the extension stroke, and only a small amount of pressurized fluid remaining in the second accumulation chamber 34 is discharged. Thus, the amount of pressurized fluid supplied to the second accumulation chamber 34 during the next retraction stroke may be as small as the amount of discharged fluid.

The first push rod 60 brought into contact with the first rod cover 30 to receive the reaction force near the end of the extension stroke exerts a force on the first piston 24 via the coil spring 68. Moreover, the second push rod 76 supported by the first rod cover 30 via the coil spring 84 also comes into contact with the first piston 24 to exert a force in the same direction as above. Since these forces act on the positions separated from the axis of the first piston rod 26 in the opposite directions by an equal distance, equalizing the forces by, for example, adjusting the spring constants of the coil spring 68 and the coil spring 84 can prevent moment causing the first piston 24 to be inclined.

Next, when the supply-and-discharge switching valve 90 is switched to the first position, pressurized fluid from the fluid supply source 96 passes through the supply-and-discharge switching valve 90 and is supplied to the drive chamber 50 through the supply-and-discharge port 16 and the second flow path 14*b* and to the second accumulation chamber 34 through the supply-and-discharge port 16 and the first flow path 14*a* on which the check valve 14*e* is disposed. As a result, the second piston 40 is driven toward the second head cover 44 while the first piston 24 is driven toward the first head cover 28; that is, the retraction stroke starts (see FIG. 12).

When the retraction stroke starts, the first push rod 60 of the communication switching valve 58 protrudes from the first piston 24 by the biasing force of the coil spring 68, and then is separated from the first rod cover 30. At the same time, the second push rod 76 of the discharge switching valve 74 protrudes from the first rod cover 30 by the biasing force of the coil spring 84, and then is separated from the first piston 24. Since the first push rod 60 protrudes from the first piston 24, the first accumulation chamber 32 and the second accumulation chamber 34 communicate with each other. Since the second push rod 76 protrudes from the first rod cover 30, the connection between the second accumulation chamber 34 and the supply-and-discharge switching valve 90 through the fourth flow path 14*d* is blocked. However, pressurized fluid continues to flow from the supply-and-discharge switching valve 90 to the second accumulation chamber 34 through the first flow path 14*a*.

As a result, pressurized fluid from the fluid supply source 96 is supplied to the drive chamber 50 and supplied to and accumulated in the second accumulation chamber 34 via the first flow path 14*a*. The pressurized fluid is then supplied to and accumulated in the first accumulation chamber 32 through the communication switching valve 58. As the retraction stroke proceeds, the second piston 40 comes into contact with the second head cover 44. The first piston rod 26 and the second piston rod 42 are pulled in to the fullest extent possible (see FIG. 9), and high-pressure fluid is accumulated in the first accumulation chamber 32 and the second accumulation chamber 34 while the pressures in the accumulation chambers are kept equal.

From this point forward, the extension stroke performed by switching the supply-and-discharge switching valve 90 to the second position and the retraction stroke performed by switching the supply-and-discharge switching valve 90 to the first position are repeated. Note that the difference between the cross-sectional areas of the second piston 40 and the second piston rod 42 is larger than the cross-sectional area of the first piston rod 26 to enable the retraction movement when pressurized fluid from the fluid supply source 96 is supplied to the drive chamber 50 and the second accumulation chamber 34 communicating with the first accumulation chamber 32.

In accordance with the fluid pressure cylinder 10 according to this embodiment, the first piston 24 in the first cylinder portion 20 can be advanced using the difference between the pressure-receiving areas in the first piston 24. That is, the first cylinder portion 20 can function as an advance transfer cylinder, and thus pressurized fluid may be supplied to the second cylinder portion 36 only when the second piston 40 is returned. This ultimately reduces the consumption of pressurized fluid.

Pressurized fluid from the fluid supply source 96 can be supplied to and discharged from the second accumulation chamber 34 and the drive chamber 50 through the single supply-and-discharge port 16. That is, the pipe 94 is the only pipe required to connect to the fluid pressure cylinder 10. This facilitates pipe routing.

At the end of the extension stroke, pressurized fluid accumulated in the second accumulation chamber 34 is discharged while the communication between the first accumulation chamber 32 and the second accumulation chamber 34 is blocked. As a result, the fluid pressure cylinder 10 can exert the maximum force on workpieces.

The first cylinder portion 20 functioning as both an output cylinder and an advance transfer cylinder and the second cylinder portion 36 functioning as a return transfer cylinder are combined in a parallel arrangement. Thus, the total length of the fluid pressure cylinder 10 can be significantly reduced compared with a case where a transfer cylinder and an output cylinder are arranged in series.

The supply-and-discharge switching valve 90 connected to the supply-and-discharge port 16 can be configured as a 3-port, 2-position switching valve. As a result, the structure of the supply-and-discharge switching valve 90 can be simplified.

In this embodiment, when viewed in the direction along the axis of the first piston rod 26, the first push rod 60 and the second push rod 76 are separated from the axis in the opposite directions by an equal distance. However, the pistons are not limited to this arrangement and may be disposed in any appropriate positions where the pistons do not come into contact with each other.

The fluid pressure cylinder according to the present invention is not limited in particular to the embodiment described above, and may have various structures without departing from the scope of the present invention as a matter of course.

What is claimed is:

1. A fluid pressure cylinder comprising:

a first cylinder portion partitioned by a first piston into a first accumulation chamber disposed on a head side and a second accumulation chamber disposed on a rod side;

a second cylinder portion partitioned by a second piston into a release chamber disposed on the head side and a drive chamber disposed on the rod side; and a supply-and-discharge port through which pressurized fluid is supplied to and discharged from the second accumulation chamber and the drive chamber, wherein:

the first cylinder portion and the second cylinder portion are disposed in parallel;

an end of a first piston rod connected to the first piston and an end of a second piston rod connected to the second piston are connected to each other; and the first piston is provided with a communication switching valve configured to switch communication between the first accumulation chamber and the second accumulation chamber, between enabled and disabled.

2. The fluid pressure cylinder according to claim 1, further comprising a release port through which the release chamber is exposed to atmosphere.

3. The fluid pressure cylinder according to claim 1, wherein the second accumulation chamber is connected to the supply-and-discharge port via a flow path provided with a check valve, the check valve allowing fluid to flow from the supply-and-discharge port toward the second accumulation chamber and blocking flow of fluid from the second accumulation chamber toward the supply-and-discharge port.

4. The fluid pressure cylinder according to claim 1, wherein:

the end of the first piston rod passes through a rod cover; and the rod cover is provided with a discharge switching valve configured to discharge pressurized fluid in the second accumulation chamber.

5. The fluid pressure cylinder according to claim 4, wherein:

the communication switching valve includes a first push rod contactable with the rod cover, the first push rod being configured to block the communication between the first accumulation chamber and the second accumulation chamber when the first push rod is brought into contact with the rod cover and pushed in; and the discharge switching valve includes a second push rod contactable with the first piston, the second push rod being configured to connect the second accumulation chamber to the supply-and-discharge port when the second push rod is brought into contact with the first piston and pushed in.

6. The fluid pressure cylinder according to claim 5, wherein, when viewed in a direction along an axis of the first piston rod, the first push rod and the second push rod are separated from the axis in directions opposite to each other by an equal distance.

7. The fluid pressure cylinder according to claim 1, wherein:

the first piston rod and the second piston rod are connected to each other by a connector plate provided with a first insertion hole and a second insertion hole, the end of the first piston rod being fitted in the first insertion hole and the end of the second piston rod being fitted in the second insertion hole;

the first insertion hole has an inside diameter larger than an outside diameter of the first piston rod; and the second insertion hole has an inside diameter larger than an outside diameter of the second piston rod.

8. The fluid pressure cylinder according to claim 1, wherein:

the supply-and-discharge port is connected to a supply-and-discharge switching valve via a pipe; and the supply-and-discharge switching valve is configured as a 3-port, 2-position switching valve switchable between a first position where the supply-and-discharge port is connected to a fluid supply source and a second position where the supply-and-discharge port is connected to a discharge port.

9. A fluid pressure cylinder comprising:

a first cylinder portion partitioned by a first piston into a first accumulation chamber disposed on a head side and a second accumulation chamber disposed on a rod side; and a second cylinder portion partitioned by a second piston into a release chamber disposed on the head side and a drive chamber disposed on the rod side, wherein:

the first cylinder portion and the second cylinder portion are disposed in parallel;

an end of a first piston rod connected to the first piston and an end of a second piston rod connected to the second piston are connected to each other;

the first piston is provided with a communication switching valve configured to switch communication between the first accumulation chamber and the second accumulation chamber, between enabled and disabled; and during a retraction stroke, pressurized fluid is supplied from a fluid supply source to the drive chamber and the second accumulation chamber while the first accumulation chamber and the second accumulation chamber communicate with each other, whereas, during an extension stroke, pressurized fluid in the drive chamber is discharged while the first accumulation chamber and the second accumulation chamber communicate with each other.

10. The fluid pressure cylinder according to claim 9, wherein, at an end of the extension stroke, the communication between the first accumulation chamber and the second accumulation chamber is blocked, and pressurized fluid in the second accumulation chamber is discharged.

* * * * *